US006773285B2

(12) United States Patent
Bernat et al.

(10) Patent No.: US 6,773,285 B2
(45) Date of Patent: Aug. 10, 2004

(54) PLUG CONNECTOR, CONSISTING OF A PLUG-IN JACK AND A PLUG PART

(75) Inventors: Jean Francois Bernat, Sartrouville (FR); Jean-Merri de Vanssay, Paris (FR)

(73) Assignee: Harting KGaA (DE)

( * ) Notice: Subject to any disclaimer, the term of this patent is extended or adjusted under 35 U.S.C. 154(b) by 0 days.

(21) Appl. No.: 10/067,656

(22) Filed: Feb. 4, 2002

(65) Prior Publication Data

US 2002/0111057 A1 Aug. 15, 2002

(30) Foreign Application Priority Data

Feb. 9, 2001 (DE) ..... 101 05 966
Aug. 6, 2001 (DE) ..... 101 38 545

(51) Int. Cl.[7] ..... H01R 13/64
(52) U.S. Cl. ..... 439/246
(58) Field of Search ..... 439/246, 8, 6, 439/9, 10, 1, 2, 31, 32, 33, 65, 63, 22, 23, 66, 74, 186, 187, 171, 172, 843, 844, 842, 845, 851, 852, 853, 891, 252, 821

(56) References Cited

U.S. PATENT DOCUMENTS 2,176,718 A * 10/1939 Linde ..... 439/252
2,603,681 A * 7/1952 Salisbury ..... 439/252
3,867,602 A * 2/1975 Jawelak ..... 200/163
4,002,400 A * 1/1977 Evans ..... 439/748
5,419,723 A * 5/1995 Villiers et al. ..... 439/843
5,906,520 A 5/1999 Frinker et al.
6,059,577 A * 5/2000 Eriksson ..... 439/8
6,497,579 B1 * 12/2002 Garbini ..... 439/63

FOREIGN PATENT DOCUMENTS

| | | | |
|---|---|---|---|
| CH | 323 737 | 9/1957 | |
| DE | 1 115 326 | 10/1961 | |
| DE | 100 361 | 9/1973 | ..... H01R/13/14 |
| DE | 37 09 903 C | 9/1993 | ..... H01R/13/02 |
| DE | 42 40 261 A | 9/1994 | ..... H01R/13/42 |
| DE | 43 19 756 A | 12/1994 | ..... H01R/13/14 |
| EP | 0 340 952 | 4/1989 | ..... H01R/13/631 |
| FR | 2 797 102 | 7/1999 | ..... H01R/13/629 |

* cited by examiner

*Primary Examiner*—Ross Gushi
(74) *Attorney, Agent, or Firm*—Hayes Soloway P.C.

(57) ABSTRACT

The invention relates to a plug-in jack comprising an insulating jack housing in which at least one jack contact is accommodated. The jack contact consists of a retaining part and a jack, the jack being mounted on the retaining part so as to be pivotable by a limited angle. The invention further relates to a plug part having an insulating plug housing in which there is accommodated at least one plug contact provided for engaging into the jack contact of the plug-in jack.

21 Claims, 6 Drawing Sheets

PLUG CONNECTOR, CONSISTING OF A PLUG-IN JACK AND A PLUG PART

TECHNICAL FIELD

The invention relates to a plug connector consisting of a plug-in jack and a plug part provided for insertion into the plug-in jack. More particularly, the invention relates to a so-called back-panel plug connector in which one of the two plug connector parts is mounted on a back-panel circuit board firmly mounted in a housing of an electrical device, the so-called motherboard, and the other part of the plug connector is mounted on a pluggable circuit board, the so-called plug-in card. When the plug-in card is inserted into the housing, the contacts of the plug-in jack and of the plug part, respectively, engage into the contacts of the other part so that the plug-in card is connected to the motherboard.

BACKGROUND OF THE INVENTION

There arises a problem in that the plug-in card cannot be guided so precisely in the housing that it can be inserted without any tolerances. This means that the contact pins and the contact jacks are laterally offset with respect to each other and/or may present a false angular position relative to each other in that moment when they hit each other during insertion of the plug-in card, i.e. that their longitudinal axes are out of alignment. The greater part of these alignment errors may certainly be corrected during insertion of the plug part into the plug-in jack; with this correction, however, comparatively high forces act on the contacts of the plug-in jack and the plug part. There is a risk that deformations and stresses on the soldering points of the contacts occur. This is especially critical for SMT connections which, in contrast to through contacts, are not positively connected with the circuit board.

BRIEF SUMMARY OF THE INVENTION

Thus, it is the object underlying the invention to provide a plug connector in which the contacts are not exposed to high mechanical loads during insertion of the plug-in card into the housing and, accordingly, of the plug part into the plug-in jack if there exists some misalignment between the plug part and the plug-in jack.

This is achieved in a plug-in jack comprising an insulating jack housing in which at least one jack contact is accommodated. The jack contact consists of a retaining part and a jack, the jack being mounted on the retaining part so as to be pivotable by a limited angle. The complementary plug part comprises an insulating plug housing in which at least one plug contact is accommodated, which is provided for engaging with the jack of the complementary plug-in jack. Since the jack is mounted so as to be pivotable on the retaining part, misalignments of the plug-in jack and the plug part relative to each other may automatically be compensated for. This prevents high mechanical loads from acting on the contacts.

According to a preferred first embodiment, it is provided that the retaining part of the plug-in jack comprises a head portion, an adjoining annular groove and a collar adjoining the annular groove and that the jack comprises a plurality of spring shackles engaging with the annular groove. On their free ends, the spring shackles preferably comprise hooks engaging with the annular groove. This makes it possible to mount the jack, in a very simple manner, to be pivotable on the retaining part. With its spring shackles, the jack is pushed over the head portion onto the retaining part, the spring shackles elastically widening when sliding over the head portion and subsequently snapping into the annular groove. There, the jack is reliably held by the hooks resting on the shoulder between the annular groove and the head portion while, at the same time, the jack may be pivoted by a certain angle. This angle is given by the difference between the width of the hooks and the width of the annular groove between the collar and the head portion. The higher this difference is, the farther the jack may be pivoted.

The jack is preferably barrel-shaped and is provided with several contact shackles at its end opposite the hook. The contact shackles widen elastically when the plug contact is pushed into the jack. The jack together with the spring shackles and the contact shackles may easily be produced in that a flat sheet stamping part is first provided with incisions so that the contact shackles and the spring shackles are formed, this stamping part then being rolled together to have the desired barrel-like shape.

According to the preferred first embodiment of the invention, the collar of the retaining part of the jack contact is adjoined by an anchor groove followed by an anchor portion accommodated in the jack housing, an annular spring being accommodated in the anchor groove, its edge facing the collar being beveled and the diameter of the collar and the head of the retaining part being less than the diameter of the anchor portion. This configuration makes it possible to assemble and mount the retaining part in the jack housing very easily. At first, the annular spring is pushed onto the anchor groove. Then the retaining part is pushed into an anchor opening in the jack housing from the rear side of the jack housing, the annular spring being elastically compressed when passing through the anchor opening and subsequently adopting its original shape again. Thus, there is formed a snap closure which makes it possible to push the retaining part into the jack housing, but impossible to pull it out in the opposite direction. In a similar manner, the plug contacts of the plug housing are received therein.

According to a preferred second embodiment, it is provided that the retaining part comprises a retaining opening and the jack comprises at least one hook engaging into the retaining opening. Here, it is preferably provided that the retaining part comprises a rectangular cross-section at least in the region of the retaining opening and that the jack is provided with two spring shackles which face each other in parallel and rest on two lateral faces of the retaining part facing away from each other. The hook may be formed by a sheet metal shackle bent from the spring shackle. The jack is reliably retained on the retaining part while the two other spring shackles resting on the retaining part make it possible, due to their elasticity, to pivot the jack in every direction on the retaining part.

It is preferably provided that the jack comprises two contact shackles facing each other in parallel and that the spring shackles face each other along a first direction being at right angles with respect to a second direction where the contact shackles face each other. The differing orientation of the contact shackles and the spring shackles ensures that a restoring force into the normal position is generated each time the jack is displaced from its normal position.

It is preferably provided that the jack is a bent sheet metal part having a closed center portion. Such a bent sheet metal part may be produced at low expenditure by stamping and bending a suitable metal sheet.

Preferably, both the retaining parts of the plug-in jack and the plug contacts of the plug parts each comprise an SMT connection which makes it possible to mount them on a circuit board via a surface mounting technique, favorable from a process engineering point of view.

Advantageous configurations of the invention may be taken from the subclaims.

DETAILED DESCRIPTION OF THE PREFERRED EMBODIMENTS

Figure 1:
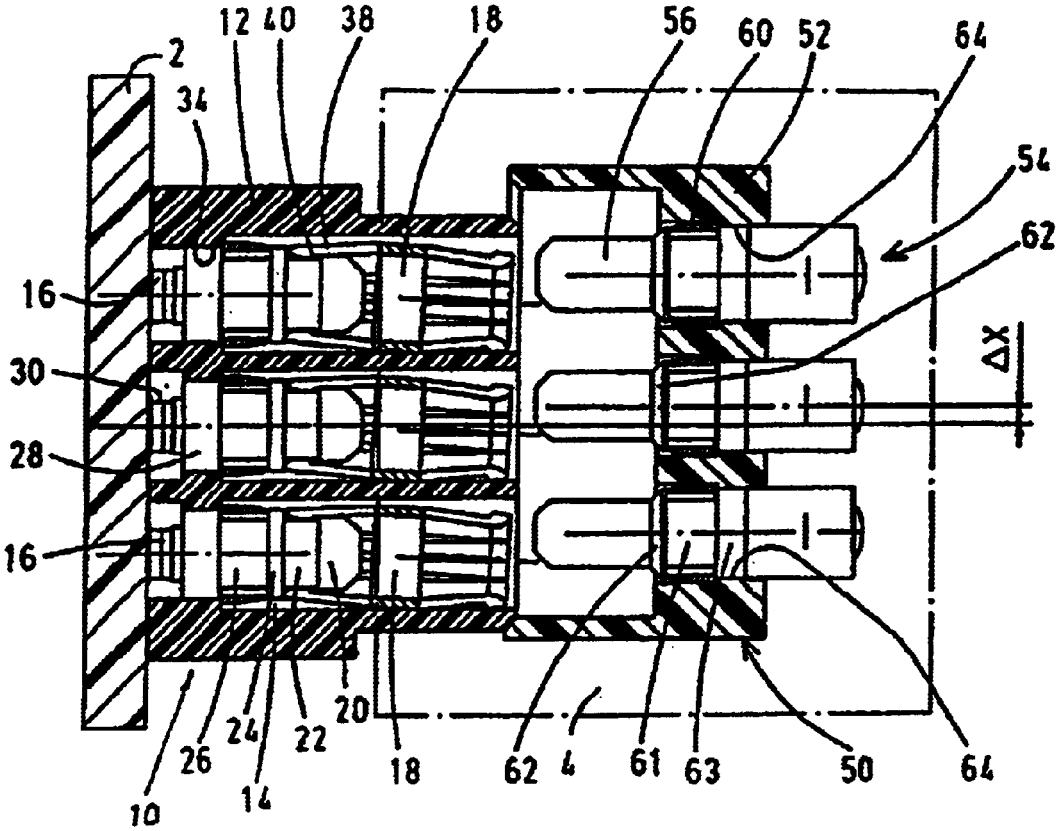
FIG. 1 is a cut plan view of a plug-in jack and a plug part according to a first embodiment at the beginning of insertion.
Figure 2:
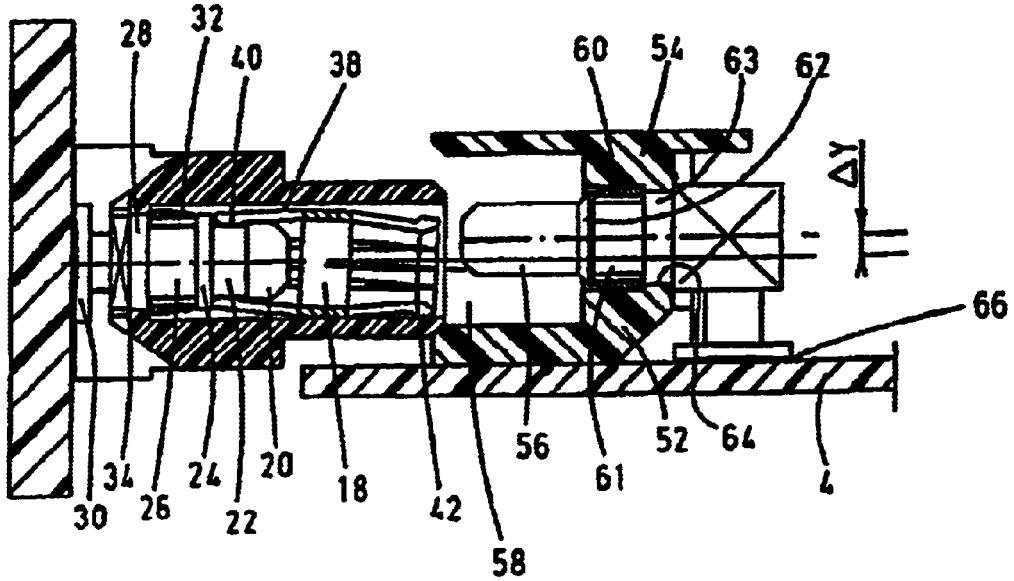
FIG. 2 is a cross-section through the plug-in jack and plug part of FIG. 1.

FIGS. 1 and 2 show a plug connector according to a first embodiment, which consists of plug-in jack 10 and plug part 50. This concerns a so-called backplane plug connector in which the plug-in jack 10 is mounted on a motherboard 2 configured as a circuit board, and the plug part 50 is mounted on a plug-in card 4 equally configured as a circuit board. Motherboard 2 is part of an electric or electronic device in which the plug-in card 4 is inserted, The guide for plug-in card 4 in the device housing is not shown here. Of course, the structure of the plug connector may also be used for other fields of application.

The plug-in jack 10 comprises an electrically insulating jack housing 12 in which three cylindrical contact chambers are formed. In each contact chamber, there is disposed a jack contact 14 consisting of a retaining part 16 and a jack 18. The retaining part comprises a head portion 20, an annular groove 22, a collar 24 adjoining the annular groove, an anchor groove 26, an anchor portion 28 as well as an SMT connection 30. The anchor portion is accommodated in an anchor opening 34 in jack housing 12. Into anchor groove 26, there is inserted an annular spring 32 which is supported between the collar 24 and a shoulder surrounding the anchor opening 34. Annular spring 32 is beveled at its end facing the collar 24 and the diameters of the collar 24 and the head portion 20 are less than the diameter of anchor opening 34. This makes it possible to insert the retaining part 16 into the jack housing 12 from the rear side thereof, that is from the left-hand side referring to FIGS. 1 and 2, until the annular spring has passed through the anchor opening 34 and is in the position shown in FIGS. 1 and 2 in which it prevents the retaining portion from being retracted.

The jack 18, which is mounted on the retaining portion, is a barrel-shaped bent sheet metal part. The jack 18 comprises a plurality of adjacent spring shackles 38 which are each provided with a hook 40 on their free ends, on the side facing the annular groove 22 (see more particularly FIG. 5). On the opposite end, there are formed several adjacent contact shackles 42. The jack 18 is mounted on the retaining part 16 by pushing it onto the retaining part in the axial direction. In so doing, the spring shackles provided with the hooks slide over the head portion 20 until they snap into the annular groove 22. Since the annular groove is longer than the hook 40 in the axial direction, jack 18 is pivotable on the retaining part by a defined angular range. This angular range is limited by the size of the contact chambers.

Plug part 50 comprises an electrically insulating plug housing 52 which is provided with a plurality of adjacent plug contacts 54 whose pin-shaped plug-in portion 56 is disposed in a contact chamber 58. For anchoring the plug contacts 54 in the plug housing 52, the same configuration is used as for the plug-in jack, i.e. annular springs 60 which are disposed in an anchor groove 61 and are supported between the collar 62 of the plug contact and a shoulder surrounding the corresponding anchor opening 64, an anchor portion 63 of the plug contact 54 being disposed in the anchor opening 64. Finally, each plug contact 54 is provided with an SMT connection 66 which is soldered onto the plug-in card 4.

Figure 3:
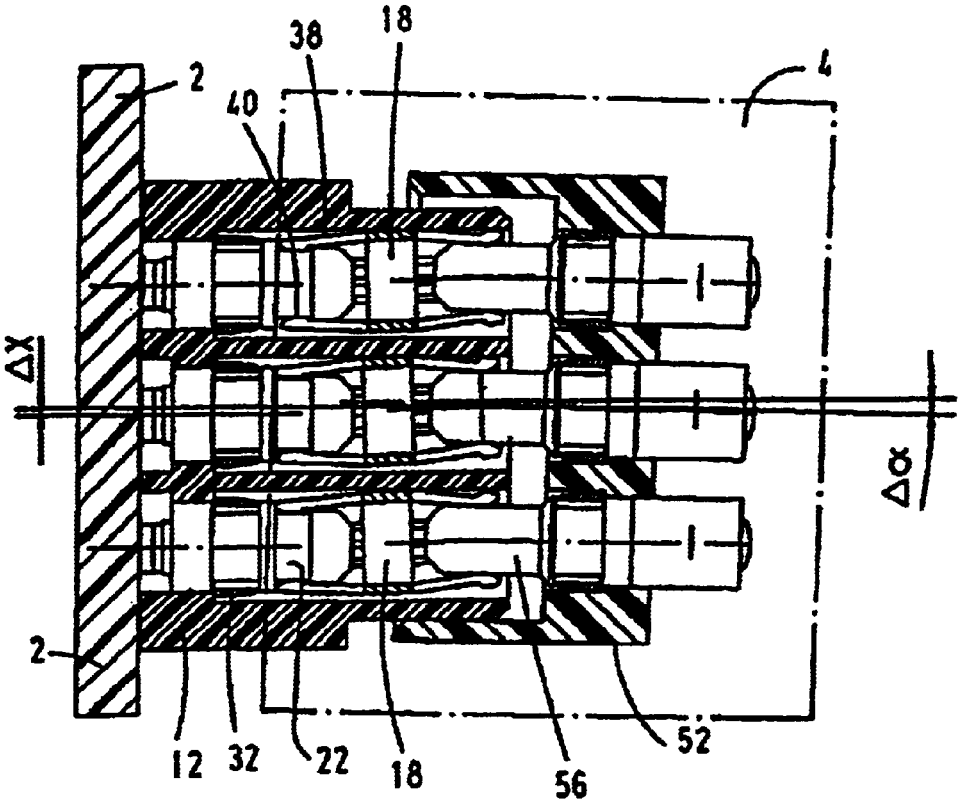
FIG. 3 is a view of the plug-in jack and the plug part during insertion, in correspondence with FIG. 2.
Figure 4:
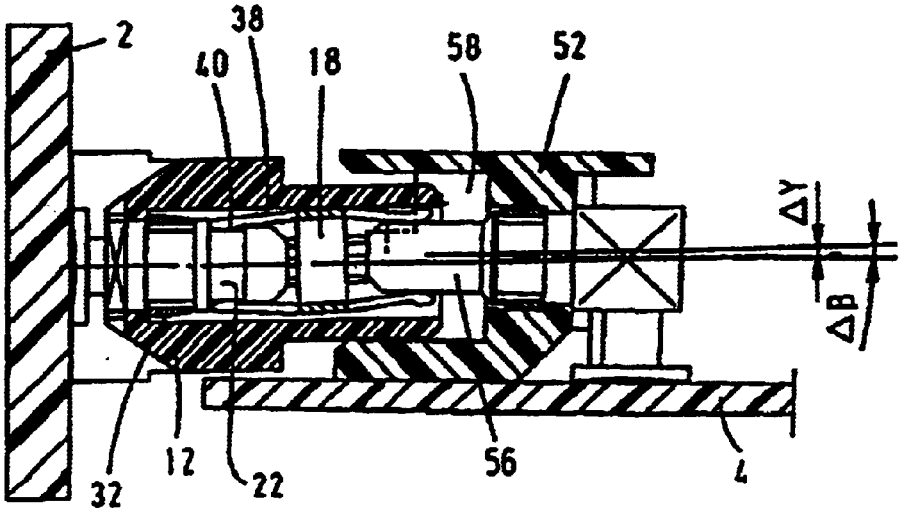
FIG. 4 is a cross-section through the plug-in jack and plug part of FIG. 3.

FIGS. 1 and 2 show the plug-in jack and the plug part at the beginning of insertion. Due to tolerances, the plug-in jack and the plug part are offset relative to each other in the x-direction and the y-direction by about 1 mm with respect to an optimal orientation in which the longitudinal axes of the plug part and the plug-in jack are aligned with each other. Lead-in bevels on the front edge of the jack housing and the plug housing result in that the misalignment is reduced during further insertion; in the condition represented in FIGS. 3 and 4, the misalignment $\Delta x$ and $\Delta y$ may be about ±0,4 mm. However, there was added an angular misalignment $\Delta\alpha$ and $\Delta\beta$ in the order of magnitude of about ±1.5° in each case. One may clearly see from FIGS. 3 and 4 that, despite these misalignments, the plug-in portion 56 of the plug contacts 54 may easily be pushed into the jacks 18 since these are pivotally mounted on the retaining part 16. In order to perform insertion without any problems, it is also supported by the conical configuration of the tip of the plug-in portion and the funnel-like configuration of the contact shackles 42 so that the jack 18 is automatically aligned properly. The potential pivoting range for the jack is selected such that in the case of larger misalignments the walls of the jack housing 12, which surround the contact chambers, and the jack housing 52 bear against each other, without high mechanical forces acting on the plug contacts and the jack contacts in this position already. This condition may be seen in FIGS. 3 and 4; the jack housing rests on the respective lower edge of the plug housing with respect to the Figures and provides mechanical support.

Figure 5:
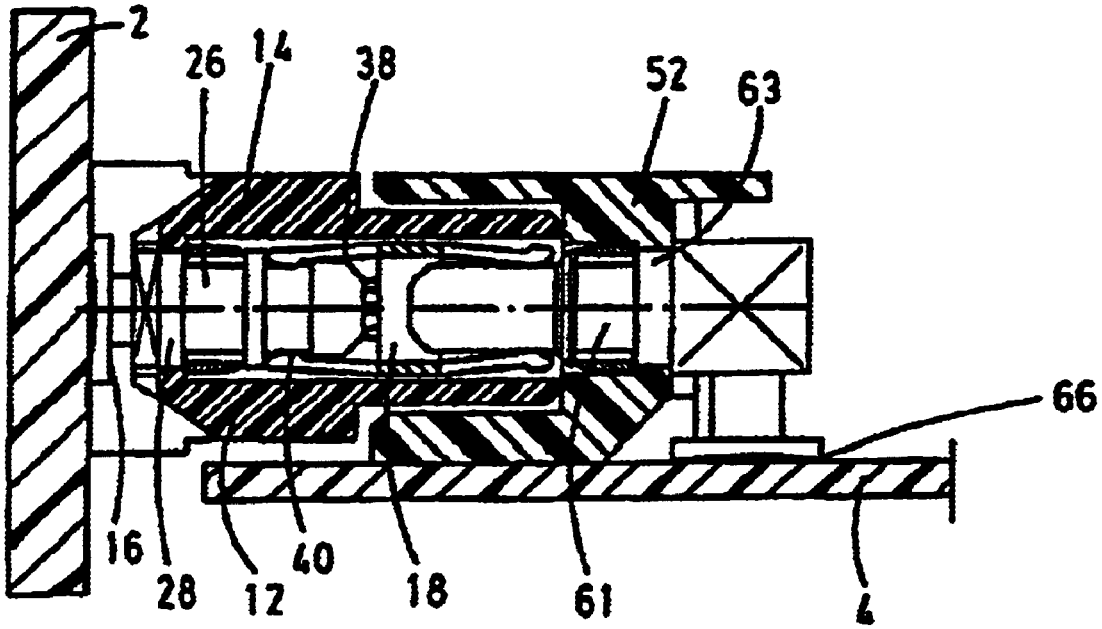
FIG. 5 is a cross-section through the plug-in jack and plug part in the completely assembled condition.

When the misalignment between the plug-in card and the motherboard is reduced during further insertion or when the misalignment is completely eliminated, the jack 18 reaches the position shown in FIG. 5, in which it extends in the longitudinal direction.

FIGS. 6 to 11 show a plug-in jack and a plug part according to a second embodiment of the invention. The same reference numerals are used for the components known from the first embodiment and reference is made to the above explanations.

Generally speaking, the difference between the first and second embodiments resides in that the retaining part 16 of the plug-in jack 10, on which the jack 18 is mounted, as well as the plug-in portion 56 in the plug part 50 which is inserted into the jack 18, each have a rectangular, flat cross-section. Correspondingly, the spring shackles 38 and the contact shackles 42 of the jack 18 are configured and disposed such that they face each other along a straight line.

Figure 6:
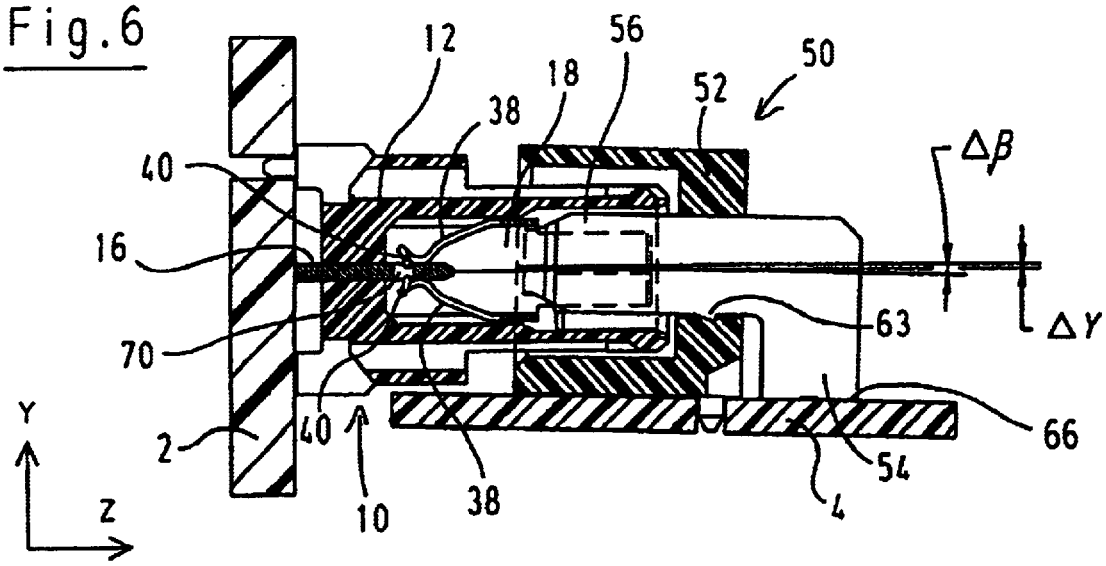
FIG. 6 is a cross-section through a plug-in jack and a plug part according to a second embodiment.
Figure 7:
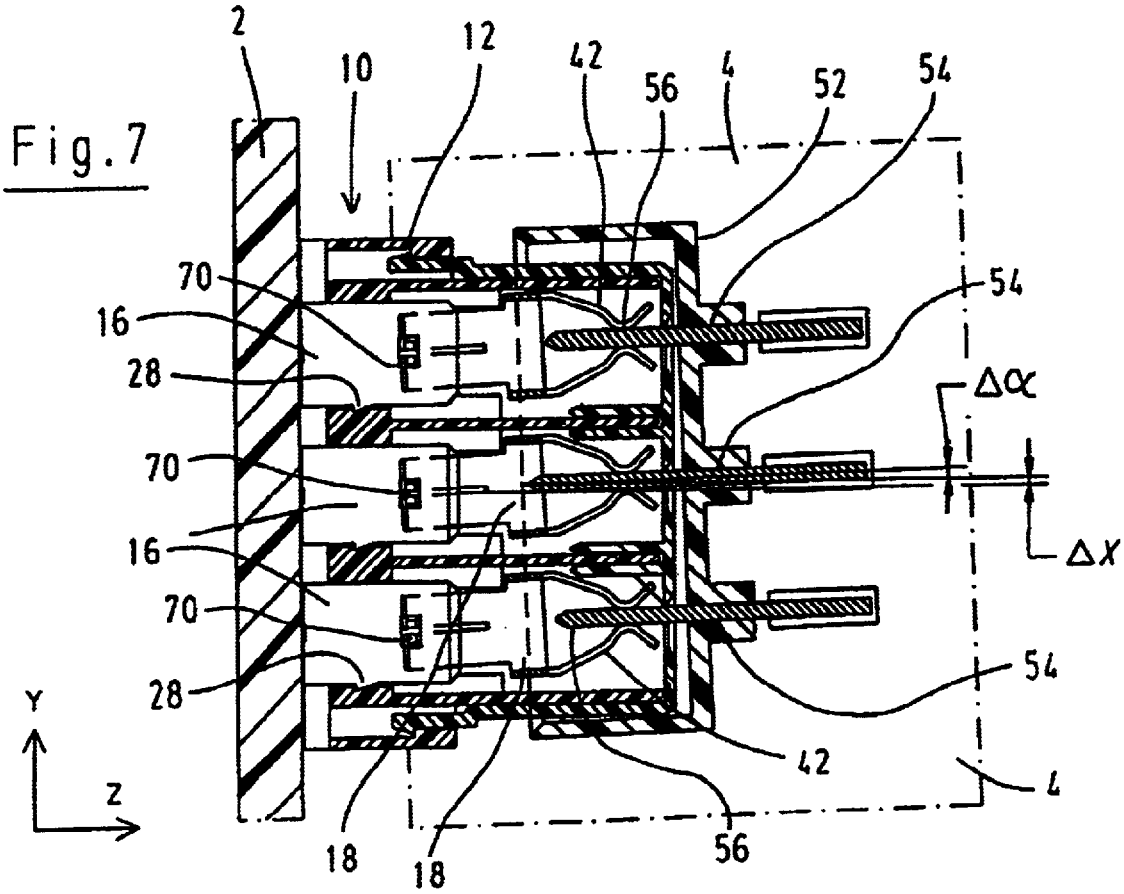
FIG. 7 is a cut plan view of the plug-in jack and the plug part of FIG. 6.

As may be seen in FIGS. 6 and 7, the retaining part 16 of the plug-in jack 10 is realized with a flat, rectangular cross-section. At a distance from the free front end of the retaining part 16, there is formed a retaining opening 70 which is rectangular.

On the retaining part 16, there is mounted a jack 18 comprising four spring shackles 38 and four contact shackles 42 (see more particularly FIGS. 8 to 11). The spring shackles and the contact shackles each start out from a center portion 72 which is configured as a closed, square-shaped ring. Jack 18 is a bent sheet metal part which is produced from a metal sheet through stamping and suitable bending. In order to close the center portion 72, a connecting shackle 74 (see more particularly FIG. 9) is provided on each outer side of the center portion, which is bent out of the plane of the center portion 72, so that it may bear against the inner surface of the other side of the center portion. There, it is attached via spot welding, for instance.

Spring shackles 38 and contact shackles 42 face each other in pairs. Each spring shackle and each contact shackle are provided with a bent portion towards their free end so that contact surfaces are formed, which are facing each other and curved in one direction.

Two of the spring shackles 38 are provided with one hook 40 each (see FIG. 11, in particular) which is constituted by a bent-off shackle. Hooks 40 are formed on crosswise situated sprig shackles 38.

Via the spring shackles 38, the jack 18 is pushed onto the retaining part 16 such that the hooks 40 engage into the retaining opening 70 (see FIG. 6, in particular). Then, the jack 18 is fixed in the z-direction, but otherwise is mounted to be pivotable on the retaining part 16. When there occurs a pivoting movement about the x-axis, the contact surfaces of the spring shackles 38 are displaced on the retaining part 16, widening in the process. During a pivoting movement about the y-axis, the jack 18 is rotated about a pivot point which is roughly situated in the center of the retaining opening 70.

The plug-in portion 56 is also configured with a flat, rectangular cross-section. Thus, the plug-in portion 56 may be pushed between the contact shackles 42 of the jack, which face each other in pairs; the contact shackles 42 then bear against the plug-in portion under line contact.

FIGS. 6 and 7 show that, due to the articulated attachment of the jack, it is possible that the latter is aligned such that, in case of possible misalignment between jack housing 12 and plug housing 52, the plug-in portion 56 may easily be inserted between the contact shackles 42. Since the orientation of the spring shackles is turned by 90° with respect to the orientation of the contact shackles, there always results a restoring force into the normal jack position when there is an oblique position of the jack between the retaining portion and the plug portion; namely, widening of the spring shackles 38 resulting from pivoting about the x-axis brings about resetting about the x-axis, while widening of contact shackles 42 resulting from pivoting about the y-axis brings about resetting about the y-axis.

Figure 8:
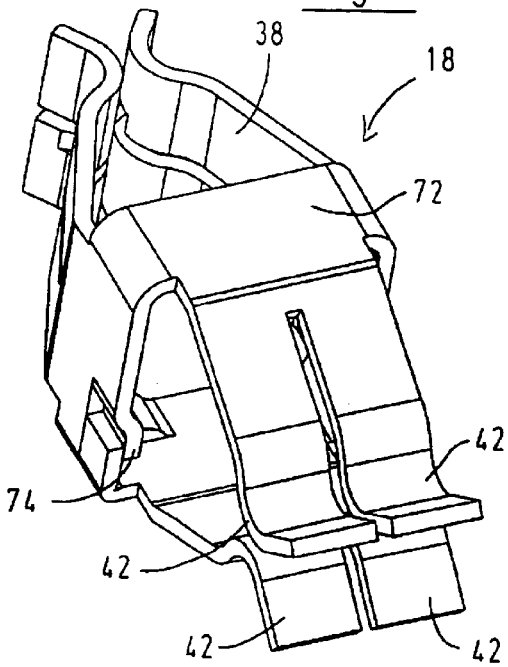
FIG. 8 is a perspective view of the jack being used in the plug-in jack of FIG. 6.
Figure 9:
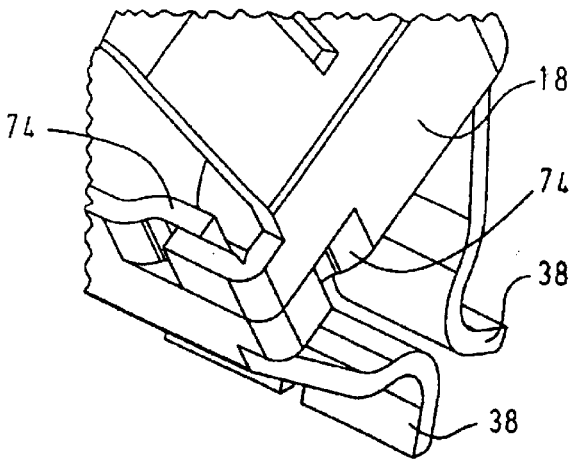
FIG. 9 is a perspective, enlarged view of one detail of the jack of FIG. 8.
Figure 10:
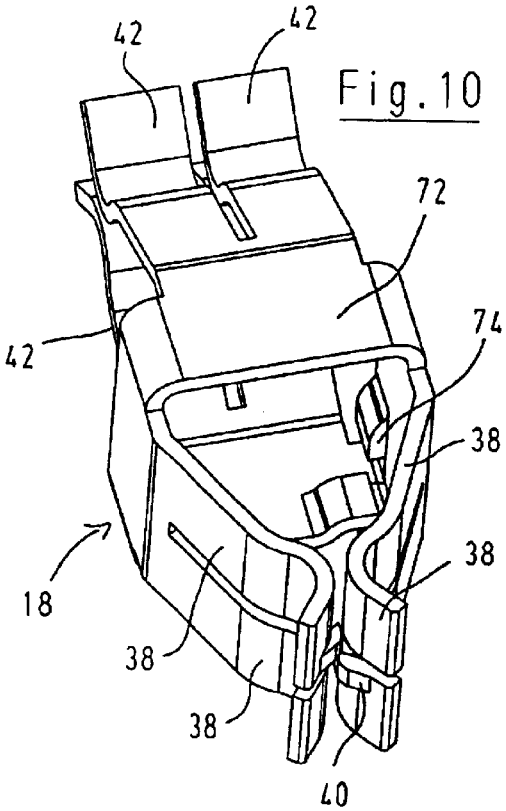
FIG. 10 is a further perspective view of the jack of FIG. 8.
Figure 11:
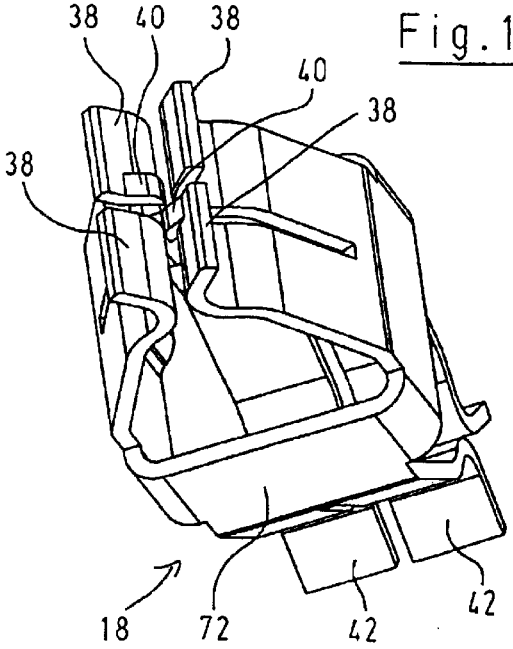
FIG. 11 is a further perspective view of the jack of FIG. 8.
Figure 12:
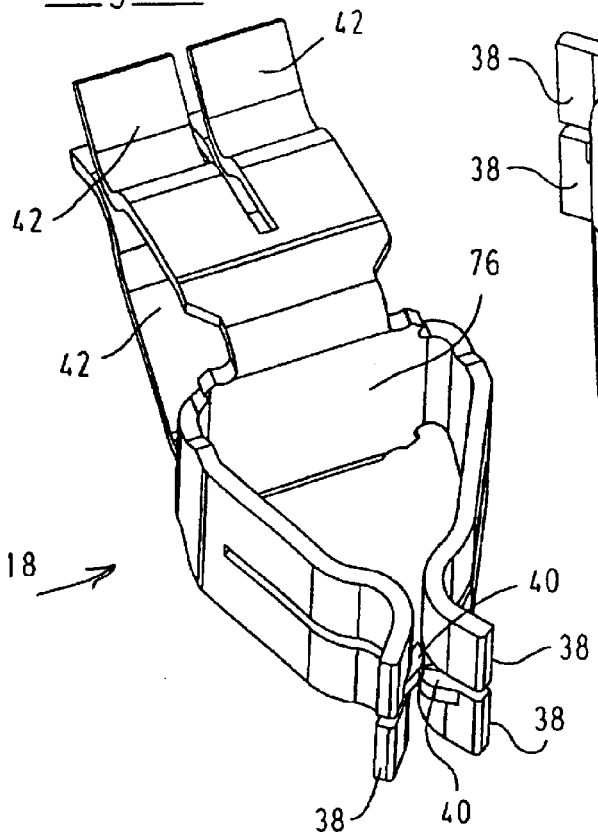
FIG. 12 is a perspective view of a jack according to a variant of the embodiment shown in FIGS. 8 to 11.
Figure 13:
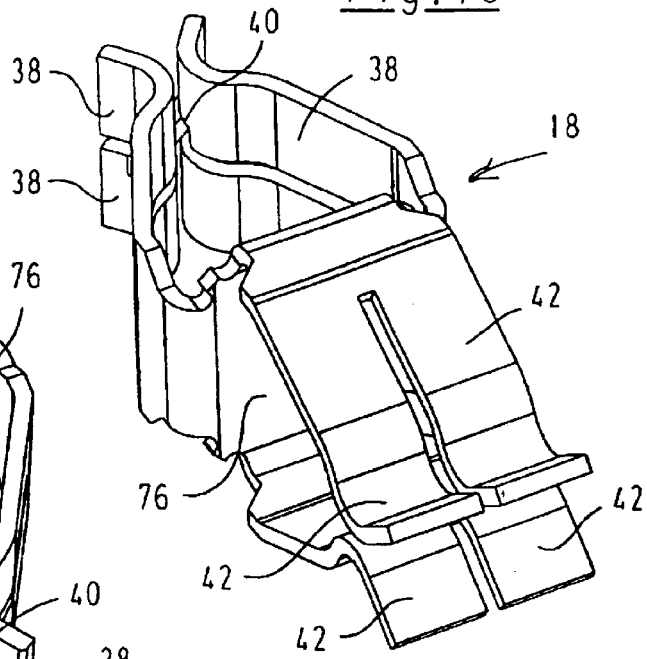
FIG. 13 is a further perspective view of the jack of FIG. 8.
Figure 14:
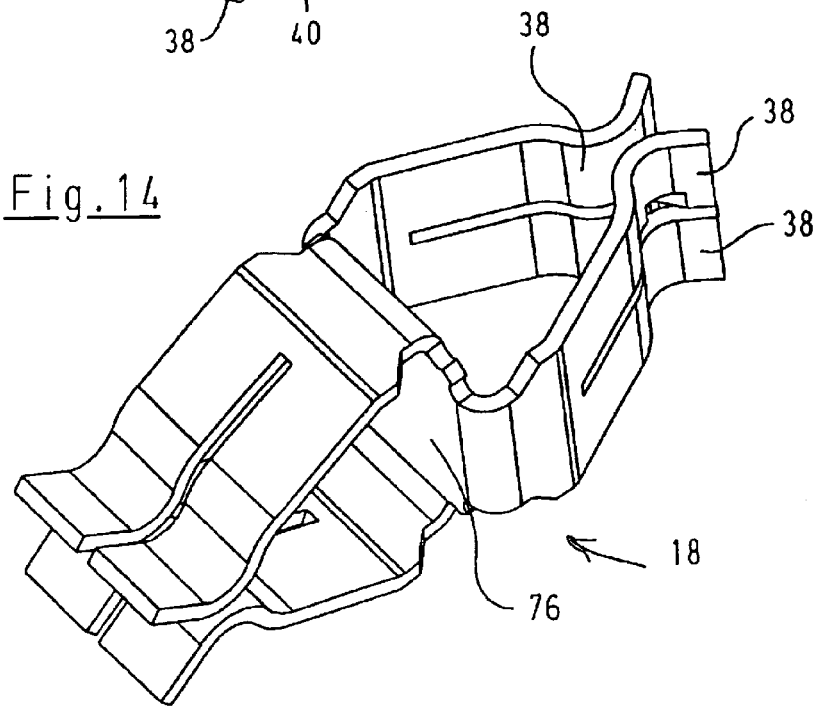
FIG. 14 is a further perspective view of the jack of FIG. 8.

FIGS. 12 to 14 represent a jack 18 according to a variant of the embodiment shown in FIGS. 8 and 11. The variant according to FIGS. 12 to 14 concerns a bent sheet metal part; however, this one does not comprise a center portion 72, but a square-shaped center plate 76. The two spring shackles 38 extend in one direction, starting out from opposite edges of the center plate, and the two contact shackles 42 extend in the opposite direction, starting out from the two other edges.

This configuration substantially offers two advantages: On the one hand, the center plate has higher rigidity against torsion than the annular center portion 72. On the other hand, the jack 18 may be produced much more easily since bending steps are necessary in two directions relative to center plate 76 only, namely upwards and downwards.

List of Reference Numerals:

2: motherboard
4: plug-in card
10: plug-in jack
12: jack housing
14: jack contact
16: retaining part
18: jack
20: head portion
22: annular groove
24: collar
26: anchor groove
28: anchor portion
30: SMT connection
32: annular spring
34: anchor opening
38: spring shackle
40: hook
42: contact shackle
50: plug part
52: plug housing
54: plug contact
56: plug-in portion
58: contact chamber
60: annular spring
61: anchor groove
62: collar
63: anchor portion
64: anchor opening
66: SMT connection
70: retaining opening
72: center portion
74: connecting shackle
76: center plate

What is claimed is:

1. A plug-in jack comprising an insulating jack housing in which at least one jack contact is accommodated, said jack contact consisting of a retaining part and a jack, said jack being mounted on said retaining part so as to be pivotable by a limited angle and capable of longitudinal movement, wherein said retaining part comprises ahead portion, an adjoining annular groove and a collar adjoining said annular groove and wherein said jack comprises spring shackles engaging with said annular groove, and wherein said collar of said retaining part is adjoined by an anchor groove followed by an anchor portion accommodated in said jack housing, an annular spring being accommodated in said anchor groove, its edge facing said collar being beveled and a diameter of said collar and said head of said retaining part being less than a diameter of said anchor portion.

2. The plug-in jack according to claim 1, wherein said retaining part is provided with an SMT (Surface Mount Technology) connection.

3. The plug-in jack according to claim 1, wherein said spring shackles have free ends and are provided with one hook on each of said free ends.

4. The plug-in jack according to claim 3, wherein said jack is barrel-shaped and is provided with several contact shackles at an end opposite said hook.

5. The plug-in jack according to claim 1, wherein said jack comprises at least one hook engaging into said retaining part.

6. The plug-in jack according to claim 5, wherein a plug-in portion of said retaining part comprises a rectangular cross-section and wherein said jack is provided with two spring shackles which face each other in parallel and rest on two lateral faces of said retaining part facing away from each other.

7. The plug-in jack according to claim 6, wherein said hook is formed by a sheet metal shackle bent away from said spring shackle.

8. The plug-in jack according to claim 6, wherein said jack is provided with two contact shackles facing each other in parallel.

9. The plug-in jack according to claim 8, wherein said spring shackles face each other along a first direction being at right angles with respect to a second direction in which said contact shackles face each other.

10. The plug-in jack according to claim 9, wherein there are provided four spring shackles which face each other in pairs, as well as four contact shackles which also face each other in pairs.

11. The plug-in jack according to claim 10, wherein said jack is a bent sheet metal part having a closed center portion.

12. The plug-in jack according to claim 11, wherein said center portion is provided on each side with one connecting shackle each, which shackle is attached to said other side of said center portion.

13. The plug-in jack according to claim 10, wherein said jack is a bent sheet metal part having a rectangular center plate, the latter being provided with edges from which said spring shackles and said contact shackles start out.

14. A plug part having an insulating plug housing in which there is accommodated at least one plug contact provided for engaging the jack contact of the plug-in jack according to claim 1.

15. The plug part according to claim 14, wherein said plug contact comprises a plug-in portion, an anchor portion and an SMT (Surface Mount Technology) connection.

16. The plug part according to claim 15, wherein said plug-in portion is pin-shaped with a round cross-section and wherein said plug-in portion is adjoined by a collar which is followed by an anchor groove which is, in turn, adjoined by said anchor portion, am annular spring being accommodated in said anchor groove, its edge facing said collar being beveled and a diameter of said plug-in portion and said collar being less than a diameter of said anchor portion.

17. The plug part according to claim 15, wherein said plug-in portion comprises a rectangular cross-section.

18. A plug part having an insulating plug housing in which there is accommodated at least one plug contact provided for engaging a jack contact of a plug-in jack comprising an insulating jack housing in which at least one jack is accommodated, said jack contact consisting of a retaining part and a jack, said jack being mounted on said retaining part so as to be pivotable by a limited angle and capable of longitudal movement, wherein said plug contact comprises a plug-in portion, an anchor portion and an SMT (Surface Mount Technology) connection, and wherein said plug-in portion is pin-shaped with a round cross-section and wherein said plug-in portion is adjoined by a collar which is followed by an anchor groove which is, in turn, adjoined by said anchor portion, an annular spring being accommodated in said anchor groove, its edge facing said collar being beveled and a diameter of said plug-in portion and said collar being less than a diameter of said anchor portion.

19. The plug part according to claim 18, wherein said plug-in portion comprises a rectangular cross-section.

20. A plug part having an insulating plug housing in which there is accommodated at least one plug contact provided for engaging a jack contact of a plug-in jack, comprising an insulating jack housing in which at least one jack contact is accommodated, said jack contact consisting of a retaining part and a jack, said jack being mounted on said retaining part so as to be pivotable by a limited angle and capable of longitudinal movement, wherein said retaining part comprises a head portion, an adjoining annular groove and a collar adjoining said annular groove and wherein said jack comprises spring shackles engaging with said annular groove, and wherein said spring shackles have free ends and are provided with one hook on each of said free ends and engaging with said annular groove, wherein said plug contact comprises a plug-in portion, an anchor portion and an SMT (Surface Mount Technology) connection, and wherein said plug-in portion is pin-shaped with a round cross-section and wherein said plug-in portion is adjoined by a collar which is followed by an anchor groove which is, in turn, adjoined by said anchor portion, an annular spring being accommodated in said anchor groove, its edge facing said collar being beveled and a diameter of said plug-in portion and said collar being less than a diameter of said anchor portion.

21. The plug part according to claim 20, wherein said plug-in portion comprises a rectangular cross-section.

* * * * *

UNITED STATES PATENT AND TRADEMARK OFFICE

CERTIFICATE OF CORRECTION

PATENT NO. : 6,773,285 B2
DATED : August 10, 2004
INVENTOR(S) : Bernat et al.

It is certified that error appears in the above-identified patent and that said Letters Patent is hereby corrected as shown below:

Column 6,
Line 60, "ahead" should be -- a head --.

Signed and Sealed this

Eighth Day of February, 2005

JON W. DUDAS
*Director of the United States Patent and Trademark Office*